US008998787B2

(12) United States Patent
Selle et al.

(10) Patent No.: US 8,998,787 B2
(45) Date of Patent: Apr. 7, 2015

(54) METHOD AND APPARATUS FOR A BAG MACHINE

(75) Inventors: Paul A. Selle, Appleton, WI (US); Gordon M. Breier, De Pere, WI (US); David G. Kuchenbecker, Appleton, WI (US); Gregory T. Prellwitz, Black Creek, WI (US)

(73) Assignee: CMD Corporation, Appleton, WI (US)

( * ) Notice: Subject to any disclaimer, the term of this patent is extended or adjusted under 35 U.S.C. 154(b) by 968 days.

(21) Appl. No.: 12/336,328

(22) Filed: Dec. 16, 2008

(65) Prior Publication Data

US 2009/0126853 A1 May 21, 2009

Related U.S. Application Data

(60) Division of application No. 11/421,304, filed on May 31, 2006, now abandoned, and a continuation-in-part of application No. 11/419,562, filed on May 22, 2006, now abandoned, and a continuation-in-part of application No. 11/346,740, filed on Feb. 2, 2006, now abandoned.

(51) Int. Cl.

| | |
|---|---|
| ***B31B 49/04*** | (2006.01) |
| ***B31B 19/14*** | (2006.01) |
| ***B31B 19/74*** | (2006.01) |
| ***B31B 19/90*** | (2006.01) |
| ***B31B 23/00*** | (2006.01) |

(52) U.S. Cl.

CPC ..... *B31B 19/14* (2013.01); *B31B 19/74* (2013.01); *B31B 19/90* (2013.01); *B31B 23/00* (2013.01); *B31B 2219/14* (2013.01); *B31B 2219/9025* (2013.01); *B31B 2219/95* (2013.01); *B31B 2237/10* (2013.01)

(58) Field of Classification Search

USPC ..... 493/3, 8, 10–15, 17–18, 22–29, 493/194–197, 199–202

See application file for complete search history.

(56) References Cited

U.S. PATENT DOCUMENTS

| | | | | |
|---|---|---|---|---|
| 4,642,084 A | | 2/1987 | Gietman | |
| 4,934,993 A | | 6/1990 | Gietman | |
| 5,215,514 A | * | 6/1993 | Flyghagen et al. | 493/193 |
| 5,292,299 A | * | 3/1994 | Anderson et al. | 493/11 |
| 5,417,638 A | * | 5/1995 | Anderson et al. | 493/11 |
| 5,447,486 A | | 9/1995 | Anderson et al. | |

(Continued)

OTHER PUBLICATIONS

Noren Products Inc., What is a heat pipe? Copyright © 1996-2005.

*Primary Examiner* — Christopher Harmon

(74) *Attorney, Agent, or Firm* — George R. Corrigan

(57) ABSTRACT

A bag machine, and method of making bags, has a sealing station a perforating station, and a downstream seal and perforation inspection station, or a perforation detection station and/or a seal inspection station is disclosed. Control of the perforating and sealing stations is preferably closed loop. The seal and perforation inspection station preferably includes a perforation detector that triggers a vision system and/or a camera, and the film is illuminated. Preferably, the inspection station is enclosed in an opaque housing, or the ambient light is otherwise blocked. The seal and perforation inspection station preferably provides an image output a display visible to a user. The vision system preferably includes a perforation location module and/or determines the distance between the seal and perforation. A downstream processing station can be provided, and can have a detected fault input, connected to a fault detect output from the seal and perforation inspection station.

18 Claims, 4 Drawing Sheets

(56) References Cited

U.S. PATENT DOCUMENTS 5,518,559 A 5/1996 Saindon et al.
5,587,032 A 12/1996 Saindon et al.
5,660,674 A * 8/1997 Saindon et al. ..... 156/353
5,861,078 A * 1/1999 Huben et al. ..... 156/353
6,117,058 A 9/2000 Sauder
6,792,807 B2 9/2004 Binder et al.
7,699,765 B2 * 4/2010 Biese et al. ..... 493/21

* cited by examiner

METHOD AND APPARATUS FOR A BAG MACHINE

RELATED APPLICATIONS

This is a divisional of and claims the benefit of the filing date of U.S. patent application Ser. No. 11/421,304, filed on May 31, 2006, which is a Continuation-in-Part of, and claims the benefit of the filing date of, U.S. patent of application Ser. No. 11/346,740, filed on Feb. 2, 2006 and application Ser. No. 11/419,562, filed on May 22, 2006, now abandoned, which is a Continuation-in-Part of, and claims the benefit of the filing date of, U.S. patent application Ser. No. 11/346,740, filed on Feb. 2, 2006.

FIELD OF THE INVENTION

The present invention relates generally to the art of bag making and bag making machines. More specifically, it relates to bag making and bag making machines where bags are formed with seals and/or perforations.

BACKGROUND OF THE INVENTION

There are many known bag machines. One style is a rotary drum machine. Rotary drum machines are well known, and found in U.S. Pat. Nos. 6,117,058, 4,934,993, 5,518,559, 5,587,032 and 4,642,084 (each of which is hereby incorporated by reference). Bag machine, as used herein, includes a machine used to make bags such as draw tape bags, non-draw tape bags, and other bags.

A detailed description of the operation of rotary bag machines may be found in the patents above, or in prior art commercially available machines such as the CMD 1270GDS or 1552ED, but their general operation may be seen with respect to FIG. 1. A prior art rotary bag machine 100 continuously processes a web 201 using a dancer assembly 203, a pair of drum-in rolls 205 and 206 (203-206 are part of an input section). A sealing station includes a sealing drum 208, a pair of drum-out rolls 210 and 211, and a sealing blanket 213. A perforating station includes a pair of knife-in rolls 215 and 216, a knife 218 (which could be any other web processing device such as a perforator, knife, die cutter, punching station, or folding station, prior to 215/216), a pair of knife-out rolls 219 and 220 (210-220 are part of an output section), and a controller 221. Perforating station, as used herein, includes a device that perforates a film. Input section, as used herein, includes the portion of a bag machine where the web is received, such as an unwind and a dancer assembly. Output section, as used herein, includes processing stations that act on a web downstream of the seals being formed, such as winders, folders, etc. Processing station, as used herein, includes any device that operates on the film, such as sealing, folding, perforating, winding, etc. Sealing station, as used herein, includes a device that seals a film The web is provided through dancer assembly 203 to drum 208. Drum 208 includes a plurality of seal bars 209. The seal bars are heated and create the seals forming the bags from web 201. The distance between seals created by the drum is related to the bag length (for bags formed end to end) or the bag width (for bags formed by making side seals). End to end bags are formed with one seal from the drum, and side to side bags are formed with a pair of seals. The drum diameter may be adjusted and/or less than all of the seal bars turned on to determine the distance between seals, and hence bag size.

Generally, rotary motion machines registers a downstream rotary knife to perforate between two seals, or beside a seal.

Variations due to tension, film gauge variation, machine variations etc., occasionally causes seals to get cut off, or the distance between a seal and perforation to be too great.

The prior art of FIG. 1 provides that after web 201 leaves drum 208 it is directed to rotary knife 218, which creates a perforation between bags, or could separate adjoining bags. When the bags are end to end bags the perforation is placed close to the single seal such that when the bags are separated, the perforation and the perforated end is the top of one bag, and the seal is the bottom of the adjoining bag. Ideally, the perforation is close to the seal to reduce waste, although this is difficult in practice. The distance between the seal and the perforation is called the skirt length. When bags are formed side to side, the perforation is made between the pair of seals. Thus, there are skirt lengths on either side of the perforation. A seal is needed on both sides of the perforation, since the side of both bags should be sealed. The web between the pair of seals is wasted. Thus, the pair of seals should be close to one another to reduce waste, although this is also difficult in practice.

Controller 221 is connected to the various components to control speed, position, etc. Sensors may be used to sense print on the web to form the seals and/or register the perforation to the seal (place it in the correct location with respect to the seal). Also, sensors may detect seals prior to the formation of the perforation to try and form the perforation in the correct location. Sensing the seal has proven to be difficult. One prior art example of a system that sensed seals is described in U.S. Pat. No. 6,792,807, hereby incorporated by reference. Another prior art patent, U.S. Pat. No. 5,447,486 uses printed marks or marks created by the seal bar to sense the location of the seal to try and register the perforation to the registration. If the perforation is placed too close to one side seal, then the seal may be cut off, rendering the bag useless.

The prior art teaches open loop control. The sensors attempt to sense the location of the seal, and then attempt to control the perforator to place the perforation in the proper location. However process variations can cause the registration to be incorrect. The prior art does not teach to close the loop and determine if the perforations was actually made in the intended location.

Accordingly, a method and machine for making bags that allows for closed loop control of the seal and perforation registration is desirable.

SUMMARY OF THE PRESENT INVENTION

According to a first aspect of the invention a bag machine has a sealing station, a perforating station, and a downstream seal and perforation inspection station.

According to a second aspect of the invention a bag machine includes a sealing station, a perforating station, and a closed loop controller, that detects the seal and perforation and/or determines the distance between them, and controls the perforating and sealing stations.

According to a third aspect of the invention a method for making bags includes imparting at least one seal to a film, and thereafter imparting at least one perforation to the film, thereby creating a bag. The distance between the seal and the perforation is monitored, and the steps are repeated to form a plurality of bags.

According to a fourth aspect of the invention a method of making bags includes sealing, perforating, and closed loop controlling the seal and perforation.

The seal and perforation inspection station can be replaced with a perforation detection station and/or a seal inspection station in various embodiments.

The inspection station includes a skirt adjust output connected to a skirt adjust input on the perforating station in one alternative.

The sealing station includes a rotary drum in another embodiment.

The seal and perforation inspection station includes a perforation detector that triggers a vision system and/or a camera that obtains an image and the film is illuminated, that can be enclosed in an opaque housing, or otherwise blocking ambient light, in other embodiments.

The seal and perforation inspection station provides an image output a display visible to a user in another embodiment.

The vision system includes a perforation location module and/or determines the distance between the seal and perforation, in other embodiments.

The perforation location module includes a perforation adjust threshold of seventy percent and/or a perforation reject threshold of ninety percent that may be adjustable by the user, and/or service personnel, in various embodiments.

A downstream processing station has a detected fault input, connected to a fault detect output from the seal and perforation inspection station in another embodiment.

Other principal features and advantages of the invention will become apparent to those skilled in the art upon review of the following drawings, the detailed description and the appended claims.

Figure 1:
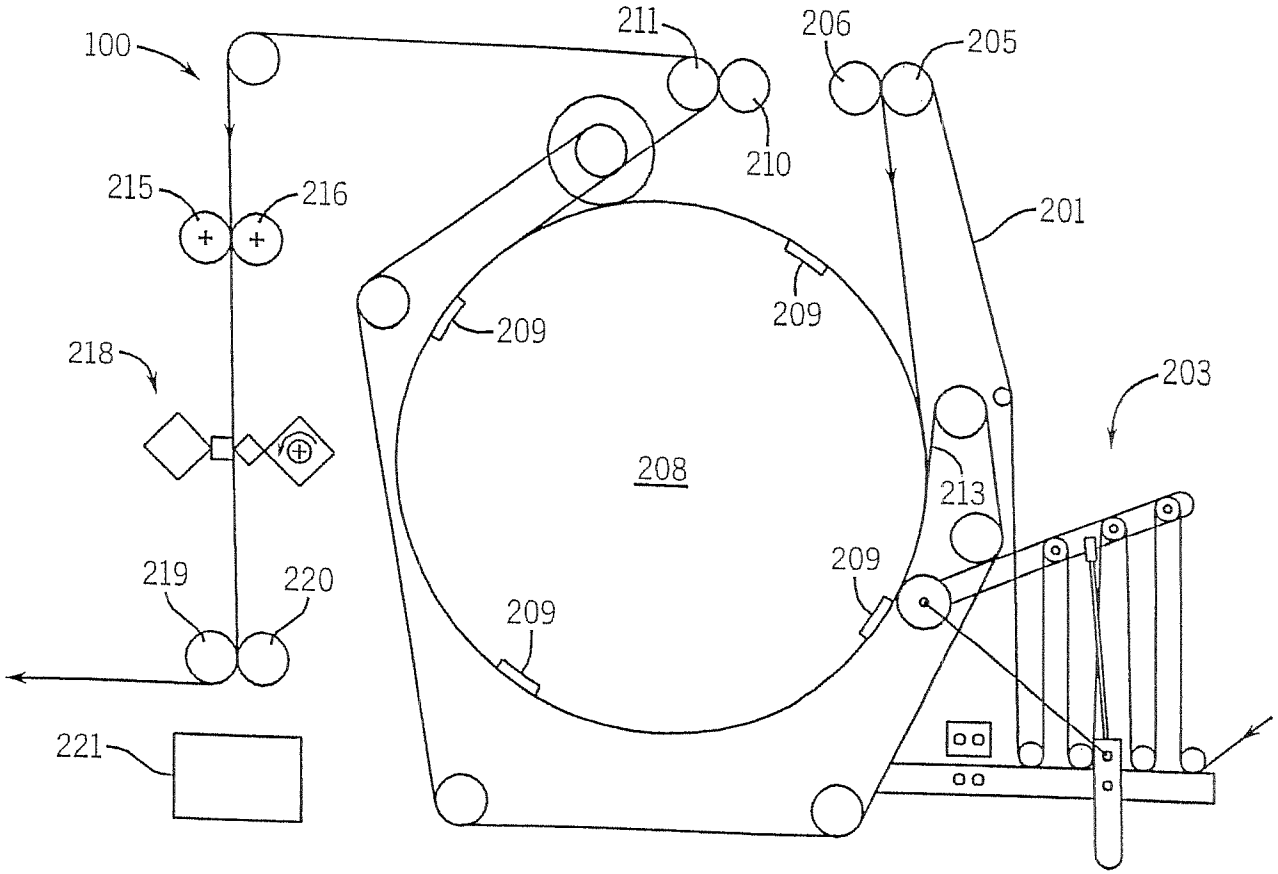
FIG. 1 PRIOR ART
FIG. 1 is bag machine in accordance with the prior art.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a continuous bag machine with a drum, and particular components, it should be understood at the outset that the invention may be implemented with intermittent machines, and/or non-drum based machines, and using other components.

Generally, the invention provides for closed loop control for seal and perforations (i.e. the skirt length) by monitoring the seal and perforation after both have been created. The machine is controlled with a closed loop controller, which can be located with a traditional controller (same housing, board, etc), or located with the device that monitors (but is still considered a controller and/or part of the main controller). The invention may be retrofitted to existing machines, including those described above, or included with new machines. Also, bags whose skirt length is undesirable can be rejected in response to the control, or the user can be notified. The system allows for the user to initially adjust the perforation location to be within the acceptable range, or for automatically adjusting it by adjusting the perforation location until it is acceptable. An alarm or warning (or the machine is stopped) is provided in the preferred embodiment if the perforation is not between seals in a side seal application.

Closed loop controlling, as used herein, includes controlling such that the parameter being controlled (skirt length, i.e.), is monitored and adjusted in response to the monitored value. Closed loop controller, as used herein, includes a controller that effects a closed loop control, and includes software hardware, and other associated components.

Figure 2:
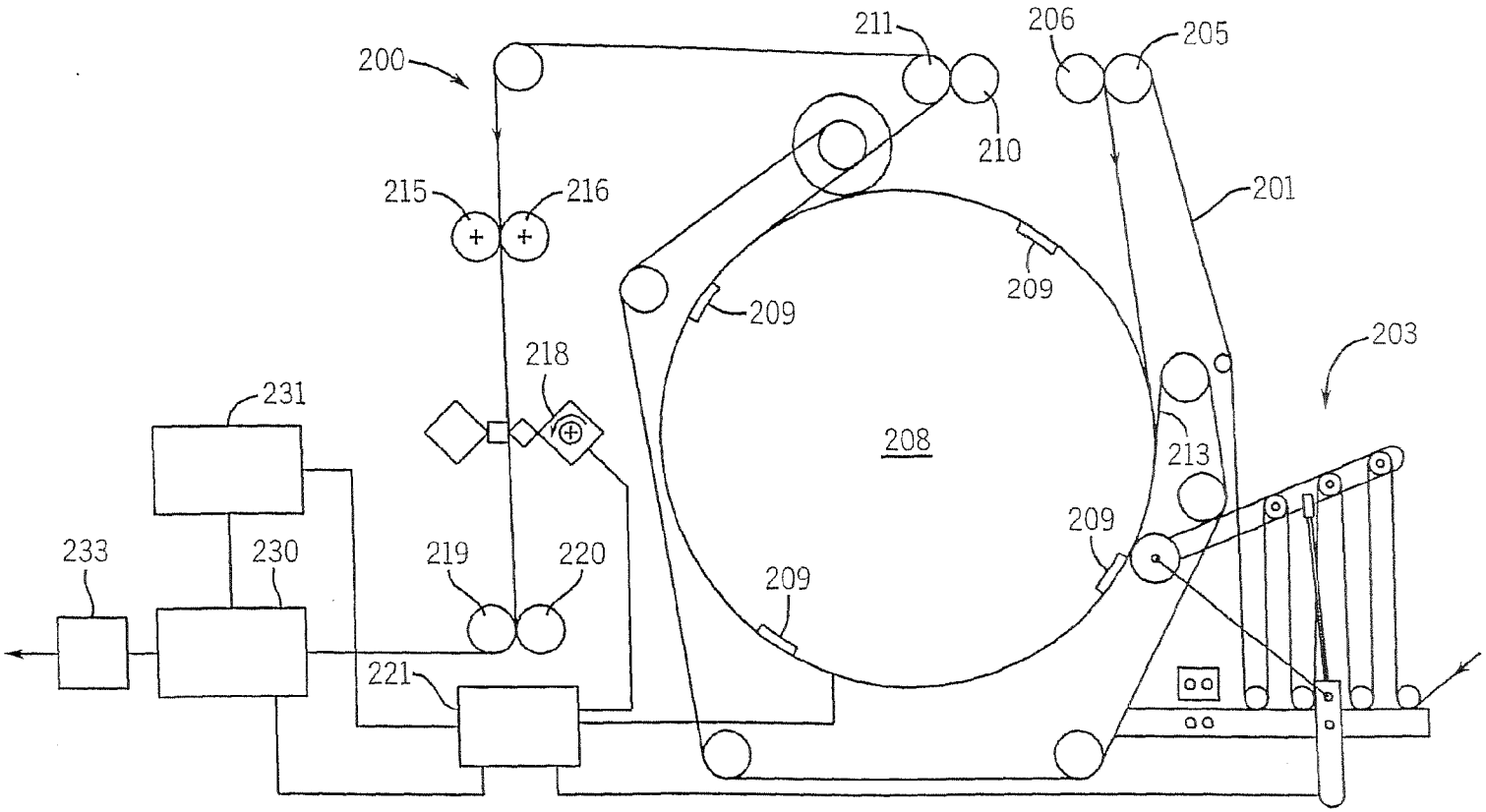
FIG. 2 is rotary drum in accordance with the present invention.

Referring now to FIG. 2, a bag machine 200 includes components similar to that of FIG. 1, but includes a seal and perforation inspection station 230. Seal and perforation inspection station, as used herein, includes components used to detect, locate and/or inspect a seal and perforation, possibly for determining if the perforation is in the proper location with respect to the seal.

Alternative embodiments provide for item 230 to be a seal inspection station 230 or a perforation detection station 230. Seal inspection station, as used herein, includes components used to detect, locate, and/or inspect a seal. Perforation detection station, as used herein, includes components used to detect a perforation. Reject signal, as used herein, includes a signal used to indicate a bag is not acceptable.

Generally, seal and perforation inspection station 230 determines if the seal and perforation are within an acceptable range. Controller 221 makes the appropriate adjustments to machine 200 if the perforation is improperly located with respect to the seal. The preferred embodiment provides for a range of acceptable skirt lengths where no adjustment is made, and a range where station 230 provides a skirt adjust output to a skirt adjust input on controller 221, which causes the perforation location to be adjusted, and a range where controller 221 or inspection station 230 provides a reject signal to a control input, and the product is rejected because the skirt length is unacceptable. Skirt adjust input, as used herein, includes an input used to change the location of the perforation relative to the seal, or the seal relative to the perforation. Skirt adjust output, as used herein, includes an output used to change the location of the perforation relative to the seal, or visa versa. Control input, as used herein, includes an input to a device that is used to control the device.

When the adjustment is made, it will be made for subsequent bags, since the present bag has already been made. Subsequent bags, as used herein, includes bags formed after a given bag, and may begin with the bag formed immediately after the given bag, or after intervening bags have been formed.

Inspection station 230 provides a reject signal on a fault detect output to a detected fault input on a downstream processing station 233 (such as a winder), that causes station 233 to reject the product, or wind a smaller roll. Fault detect output, as used herein, includes an output indicative a parameter (skirt length, e.g.) being outside an acceptable range. Detected fault input, as used herein, includes an input indicative of a parameter (skirt length, e.g.) being outside an acceptable range.

The preferred embodiment has a perforation adjust threshold, for side seal bags, of 70%. Perforation adjust threshold, as used herein, is the middle portion of the distance between seals where it is desired to form the perforation, and outside of that portion the perforation location is adjusted, such that a threshold of 70% means that if the perforation is within the portion centered about the optimum perforation location, and covers 70% of the total distance between seals, i.e. 35% on either side on the optimum, then the location of the perforation is not adjusted. If the perforation is not within this portion, then the perforation or seal location is adjusted. Alternatives provide for ranges that are not centered.

The preferred embodiment also has a perforation reject threshold of 90%. Perforation reject threshold, as used herein, is the middle portion of the distance between seals where it is desired to form the perforation, and outside of that portion the perforation is not acceptable, such that a threshold of 90% means that if the perforation is outside the portion centered about the optimum perforation location, and covers 90% of the total distance between seals, i.e. 45% on either side on the optimum, then the perforation is not acceptable. A fault signal is then given to downstream equipment. The system can also adjust the skirt length when the reject threshold is reached. Alternatives provide for ranges that are not centered. These threshold definitions are merely mathematical constructs and other constructs may be used.

Other embodiments provide for thresholds for end seals, for example +/−40% of the optimal skirt length for adjusting, and +/−80% of the optimal skirt length for rejecting product. The thresholds for side or end seals can be set as a percent of a relative distance. Relative distance, as used herein, includes a measured distance as a percent of a distance between seals.

A user display 231 receives data, such as image data error data, or other data, and displays it for the user. It can be a video display, image display, monitor, lights, etc.

Figure 3:
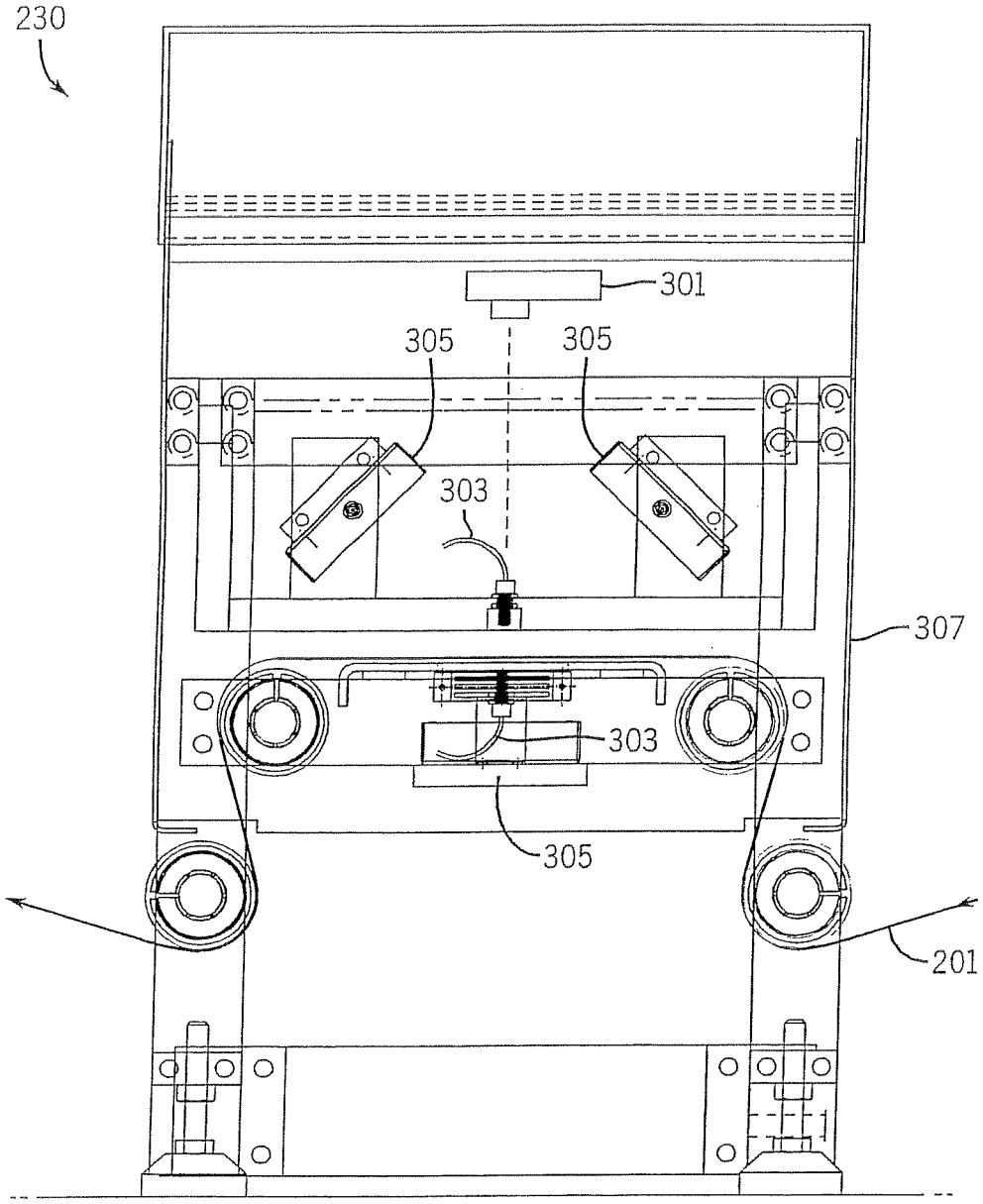
FIG. 3 is a cross sectional side view of a seal and inspection station in accordance with the present invention.

Referring now to FIG. 3, a cross section side view of the preferred embodiment of station 230 includes a vision system 301, a perforation detector 303, and lights 305 (including lights on both sides of 201). Film 201 passes through station 230, and perforation detector 303 detects a perforation in the preferred embodiment. Vision system, as used herein, includes a camera or sensor and associated components for obtaining an image, and/or processing the image, and/or detecting a formation on a film. Perforation detector, as used herein, includes a detector, such as an optical sensor (photoelectric eye), a force sensor or acoustical sensor, (such as in U.S. Pat. No. 6,792,807), or any other sensor, that detects a perforation. The perforation detector may be a prior art detector, such as a model D10 available from Banner Engineering, or the like.

Perforation detector 303 sends a trigger signal that causes vision system 301 to obtain an image of the film when the perforation is detected. Vision system 301 preferable includes a camera or other sensor. Camera, as used herein, includes, a device used to obtain an image. Vision system and camera 301 are model P4 available from Banner Engineering in the preferred embodiment. Trigger, as used herein, includes a signal used to cause an image to be obtained.

The logic associated with vision system 301 (which may be considered a controller and part of controller 221, or a separate controller, regardless of its location and configuration) includes a perforation location module that determines the location of the perforation with respect to the seal (or visa versa). Vision system, as used herein, includes a camera and associated components for obtaining an image and/or processing the image, and/or detecting a formation on a film. Perforation location module, as used herein, includes components, such as logic and detection components, that locate a perforation with respect to another formation on the film, or to a location on the film.

A housing 307 encloses station 230 and is opaque in the preferred embodiment to shield light from affecting the image. Preferably, an access door is built into the housing. Also lights 305 (preferably infrared lights) provide consistent illumination of film 201. Alternatives include more or fewer lights, and a housing that is not opaque, or is partially opaque.

Figure 4:
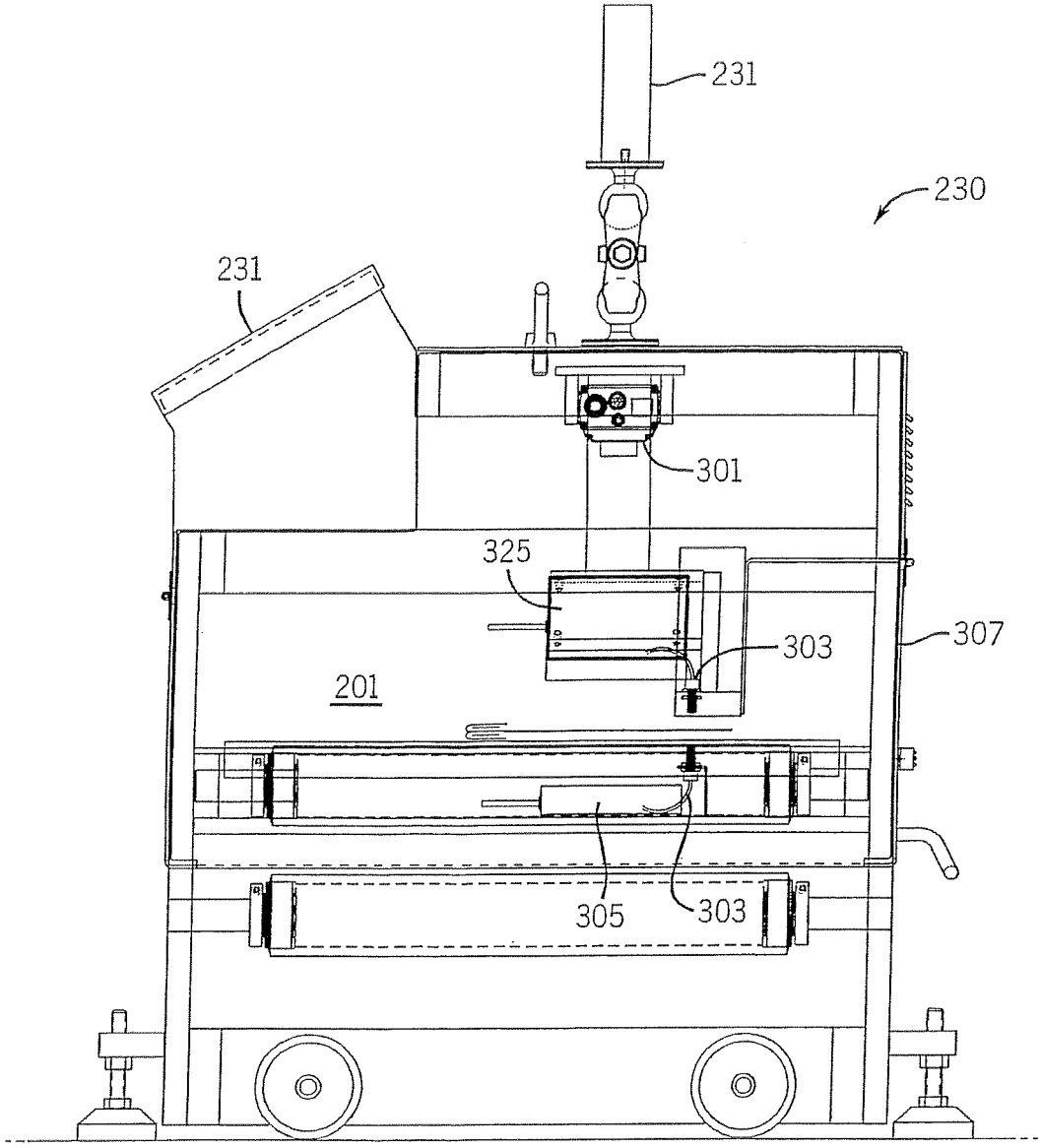
FIG. 4 is a cross sectional end view of a seal and inspection station in accordance with the present invention.

Referring now to FIG. 4, a cross sectional end view of station 230 is shown. Perforation detector 303 preferably senses the perforation near the edge of the film (and opposite the drawtape if the bags are draw tape bags). Camera 301 preferably obtains an image near the center of the film. Every perforation triggers an image capture, and camera 301 provides an image output to display 231 (such as an LCD, plasma or CRT display). Also, LEDs are illuminated on display 231 to indicate to the user the status of the seal/perforation registration (acceptable, adjusting, rejected, etc.). Vision system 301 identifies the seal and/or perforation, and determines the distance therebetween, or relative locations.

Image output, as used herein, includes an output that includes image data, such as that which can be shown on a display. This allows the user to see the perforation and seals. The image may be updated every bag, or the user can freeze the image to inspect a single image more closely. The system may be used without a display, but it can be helpful during setup.

Proper tuning of vision system 301 allows it to consistently identify the perforations and seals, and determine the distance therebetween, particularly when an opaque housing and lighting are provided. The vendor or manufacturer of the vision system can provide the logic necessary to operate vision system 301. The distance nay be determined by software from the image, or encoder pulses may be counted from the detection of the perforation to the location of the seal. Vision system 301 might need adjusting for each color, thickness, and/or type of film used, and/or there may be user inputs, such as switches, keyboards, etc, wired or wireless, to select optimal settings for different film types. The preferred embodiment operates on LDPE film, 0.7-1.1 mils thick, with at least 3% added color such as black or white.

When system 301 determines that the distance between the seal and the perforation is greater than the perforation adjust threshold, it provides the skirt adjust output to perforating station 218 that advances or retards the perforation position. Many prior art machines allowed the user to adjust skirt length by pressing a user input or turning a knob. When the invention is implemented by retrofitting an existing machine, the skirt adjust output may be easily tied to the user input, to take advantage of exiting control circuitry. The skirt length is "jogged" until the measured distance is less than the threshold, or "jogged" one time in various embodiments. If the distance between inspection station 230 and perforating station 218 is more than one bag length, any changes will not be observed until the intervening bags pass inspection station 230. Alternative embodiments provide for not "readjusting" the skirt length until intervening bags pass, not adjusting more than once in a given time period, such as every fifteen seconds, or for adjusting in small enough increments to avoid overshoot problems. Another alternative provides for temporarily adjusting the drum diameter to change the location of the seal relative to the perforation.

When system 301 determines that the distance between the seal and the perforation is greater than the perforation reject threshold it provides the fault detect output to station 233 to reject the unacceptable product, and/or sounds an alarm or other user notification (or stops the machine).

Various alternative embodiment provide for either vision system 301 or perforation detector 303 being omitted, and/or adjustments and rejections made based on a series of measurements (an average or trend, e.g.), rather than a single measurement. Another embodiment includes using an array of optical seal sensors (such as a Tritronics Smart Eye II, or any contrast-sensing photo optical sensors) in place of vision system 301. Also, an array of force sensors, such as that shown in U.S. Pat. No. 6,792,807, hereby incorporated by reference, to mechanically or acoustically detect the seals (a single sensor can be used for the perforation). The array detects the seal, and using encoder pulses the controller determines the distance between the seal and the perforation. A seal is detected if a number of the sensors agree (such as 2 of 3), to reduce erroneous data from wrinkles etc. Preferably, at least one sensor is directed at the draw tape seal (if the bags are draw tape bags). A single detector is used in another embodiment. The array can be used before or after the perforator and used in an open loop system.

Various embodiments provide for the user to be able to adjust the various thresholds, through a keyboard or other user input, wired or wireless. The threshold adjust can be password protected. Other alternatives provide for sounding an alarm, stopping the machine, or otherwise notifying the user if no perforations are detected (for a period of time or for a number of encoder pulses or bags).

Numerous modifications may be made to the present invention which still fall within the intended scope hereof. Thus, it should be apparent that there has been provided in accordance with the present invention a method and apparatus for making bags that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are define as follows:

1. A method for making bags, comprising:

imparting at least one seal to a film;

thereafter imparting at least one perforation to the film, thereby creating a bag;

thereafter monitoring the distance between the at least one imparted seal and the at least one imparted perforation;

automatically adjusting a skirt length for at least some subsequent bags in response to the monitoring; and repeating the method to form a plurality of bags.

2. The method of claim 1, wherein imparting at least one seal includes rotating a sealing drum that is in contact with the film.

3. The method of claim 2, wherein monitoring includes detecting the imparted perforation and obtaining an image of the film as it passes a location in response to detecting, and illuminating the film at least in the location.

4. The method of claim 3 further comprising blocking ambient light from the location.

5. The method of claim 3, further comprising displaying the image on a user-viewable display.

6. The method of claim 1, wherein monitoring includes determining a relative distance between the at least one imparted perforation and the at least one imparted seal, relative to the distance between seals.

7. The method of claim 6, further comprising adjusting a skirt length for at least some subsequent bags in response to the monitoring in the event the relative distance is outside of a desired range.

8. The method of claim 7, wherein the at least one seal is two seals, and the desired range is seventy percent of the distance between the two seals, centered between the two seals.

9. The method of claim 6 further comprising providing a reject signal for at least one bag in response to the monitoring in the event the relative distance is outside of a second desired range.

10. The method of claim 9, wherein the at least one seal is two seals, and the seals desired range is ninety percent of the distance between the two seals, centered between the two seals.

11. A bag machine for making bags, comprising:

means for imparting at least one seal to a film;

means for thereafter imparting at least one perforation to the film, thereby creating a bag; and means for thereafter monitoring the distance between the at least one imparted seal and the at least one imparted perforation.

12. The bag machine of claim 11, further comprising means for adjusting a skirt length for at least some subsequent bags in response to the monitoring.

13. The bag machine of claim 12, wherein the means for imparting at least one seal includes a sealing drum that is in contact with the film.

14. The bag machine of claim 13, wherein the means for monitoring includes means for detecting the imparted perforation and means for obtaining an image of the film as it passes a location in response to the means for detecting, and means for illuminating the film at least in the location.

15. The bag machine of claim 14, further comprising means for blocking ambient light from the location.

16. The bag machine of claim 15, further comprising means for displaying an image of the film on a user viewable display.

17. The bag machine of claim 14, wherein the means for monitoring includes means for determining a relative distance between the at least one imparted perforation and the at least one imparted seal.

18. The bag machine of claim 17, further comprising means for providing a reject signal for at least one bag in response to the means for determining.

* * * * *